US008967917B1

(12) United States Patent
Hilfiker, Jr.

(10) Patent No.: US 8,967,917 B1
(45) Date of Patent: Mar. 3, 2015

(54) RETAINING WALL SYSTEM

(71) Applicant: William B. Hilfiker, Jr., Fortuna, CA (US)

(72) Inventor: William B. Hilfiker, Jr., Fortuna, CA (US)

(73) Assignee: Hilfiker Pipe Co., Inc., Eureka, CA (US)

( * ) Notice: Subject to any disclaimer, the term of this patent is extended or adjusted under 35 U.S.C. 154(b) by 0 days.

(21) Appl. No.: 13/907,882

(22) Filed: Jun. 1, 2013

Related U.S. Application Data

(63) Continuation-in-part of application No. 13/485,673, filed on May 31, 2012, now Pat. No. 8,602,691.

(51) Int. Cl.
*E02D 29/02* (2006.01)

(52) U.S. Cl.
CPC ..... *E02D 29/02* (2013.01)
USPC ..... 405/262; 405/284

(58) Field of Classification Search
CPC ..... E21D 21/0086; E21D 21/02; E21D 17/20; E21D 17/202; E21D 29/02; E21D 29/0225; E21D 29/0233; E02D 29/02
USPC ..... 405/262, 284, 302.4, 302.7
See application file for complete search history.

(56) References Cited

U.S. PATENT DOCUMENTS

| | | | | | |
|---|---|---|---|---|---|
| 4,564,316 | A * | 1/1986 | Hunziker | 405/262 |
| 4,856,939 | A * | 8/1989 | Hilfiker | 405/284 |
| 5,456,554 | A * | 10/1995 | Barrett et al. | 405/284 |
| 5,588,784 | A * | 12/1996 | Brandl et al. | 405/262 |
| 6,024,516 | A * | 2/2000 | Taylor et al. | 405/262 |
| 6,769,222 | B2 * | 8/2004 | Billante | 52/741.15 |
| 6,874,975 | B2 * | 4/2005 | Hilfiker et al. | 405/262 |
| 8,602,691 | B1 * | 12/2013 | Hilfiker | 405/262 |
| 2004/0109729 | A1 * | 6/2004 | Hilfiker et al. | 405/262 |
| 2006/0204342 | A1 * | 9/2006 | Hilfiker et al. | 405/262 |
| 2012/0087742 | A1 * | 4/2012 | Ogorchock | 405/262 |

* cited by examiner

*Primary Examiner* — Benjamin Fiorello
(74) *Attorney, Agent, or Firm* — Eric Karich

(57) ABSTRACT

A retaining wall system has a plurality of pilasters, a plurality of spiralnails, a wire truss system, and a plurality of face panels. The plurality of pilasters are horizontally spaced along the earthen embankment, and each have an elongate pilaster body that is vertically mounted on the earthen embankment. The plurality of spiralnails that have each been driven into the earthen embankment are attached to one of the plurality of pilasters to anchor the pilasters in the earthen embankment. The wire truss system is operably mounted on the plurality of pilasters, and includes a pilaster attachment portion, a wire lattice body with a V-shaped portion, and an interlocking portion that interlocks with at least one adjacent truss element. The plurality of face panels are operably attached to the wire truss system to cover the V-shaped portions of the truss elements.

15 Claims, 12 Drawing Sheets

RETAINING WALL SYSTEM

CROSS-REFERENCE TO RELATED APPLICATIONS

This application for a utility patent is a continuation-in-part of a previously filed utility patent, having the application Ser. No. 13/485,673, filed May 31, 2012.

BACKGROUND OF THE INVENTION

1. Field of the Invention

This invention relates generally to the construction of retaining walls, and more particularly to an apparatus and method constructing such walls through the use of spiralnails attached to pilasters which support a specially constructed wire truss system.

2. Description of Related Art

The following art defines the present state of this field:

Hilfiker et al., U.S. Pat. No. 6,874,975, teaches a soil reinforced retaining wall for an earthen embankment which is formed by driving nails into the embankment at spaced intervals. The nails have helical threads extending there-around of such proportion and pitch as to screw into the formation as the nails are driven into place with a vibratory hammer, without prior boring of the embankment to accommodate the nails, or the necessity of cementing the nails into place. The wall is constructed from the top down and face panels are progressively assembled over the embankment and secured in place by the nails. This patent is hereby incorporated by reference in full.

The prior art teaches an apparatus and method for constructing soil reinforced earthen retaining walls, such as is described above. However, the prior art does not teach the use of spiralnails attached to pilasters which support a specially constructed wire truss system. The present invention fulfills these needs and provides further related advantages as described in the following summary.

SUMMARY OF THE INVENTION

The present invention teaches certain benefits in construction and use which give rise to the objectives described below.

The present invention provides a retaining wall system for installation on an earthen embankment. The retaining wall system has a plurality of pilasters, a plurality of spiralnails, a wire truss system, and a plurality of face panels. The plurality of pilasters are horizontally spaced along the earthen embankment, and each have an elongate pilaster body that is vertically mounted on the earthen embankment. The plurality of spiralnails that have each been driven into the earthen embankment are attached to one of the plurality of pilasters to anchor the pilasters in the earthen embankment. The wire truss system is operably mounted on the plurality of pilasters for supporting the earthen embankment.

A primary objective of the present invention is to provide a retaining wall system having advantages not taught by the prior art.

Another objective is to provide a retaining wall system that is inexpensive to manufacture and easy to install.

A further objective is to provide a retaining wall system that is strong and durable.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a retaining wall system 10 for installation on an earthen embankment 12.

Figure 1:
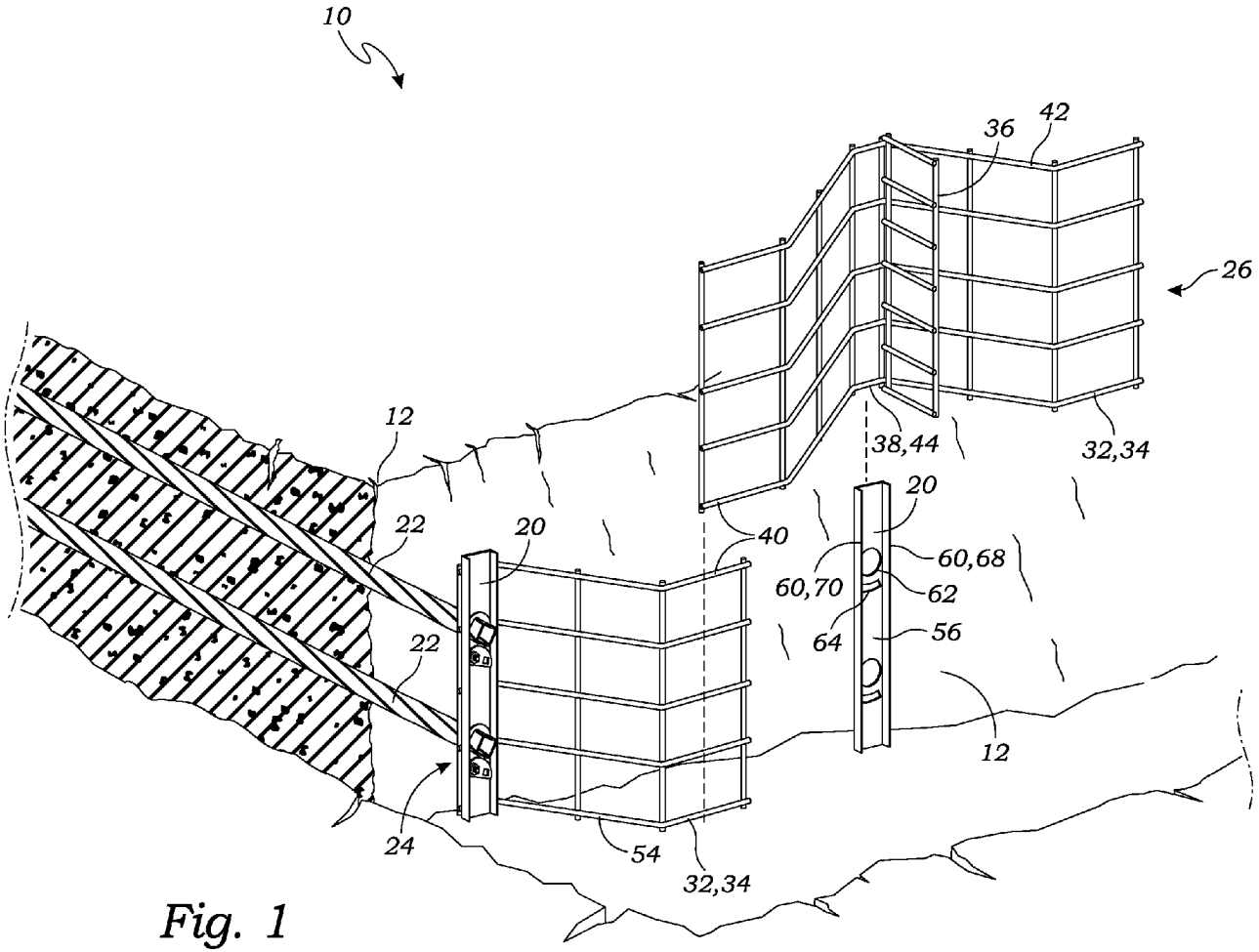
FIG. 1 is an exploded perspective view of a first step in the construction of one embodiment of a retaining wall system, illustrating the installation of initial truss elements and pilasters, each of the truss elements having a V-shaped portion.
Figure 2:
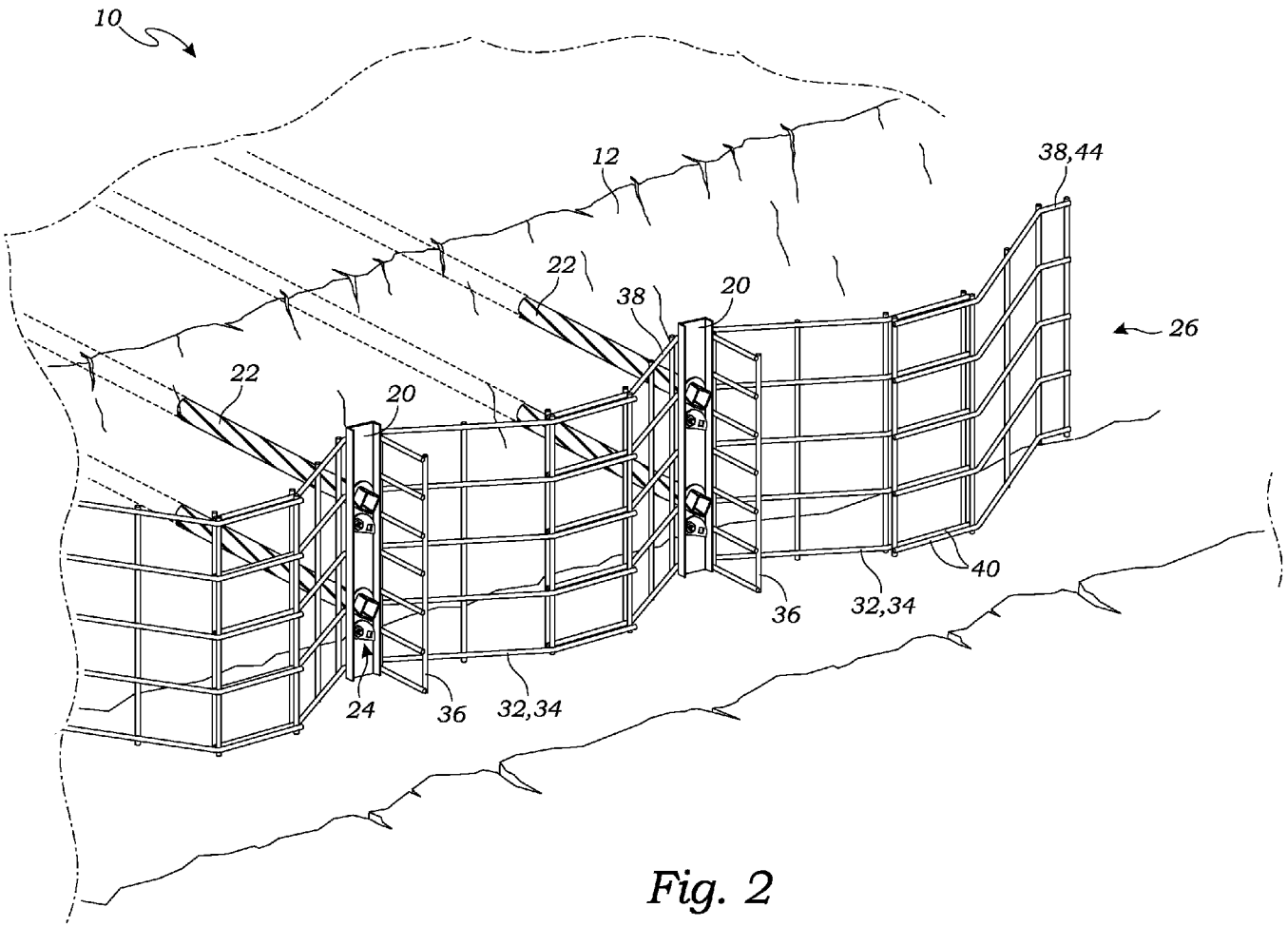
FIG. 2 is a perspective view of the retaining wall system following installation of additional truss elements.
Figure 3:
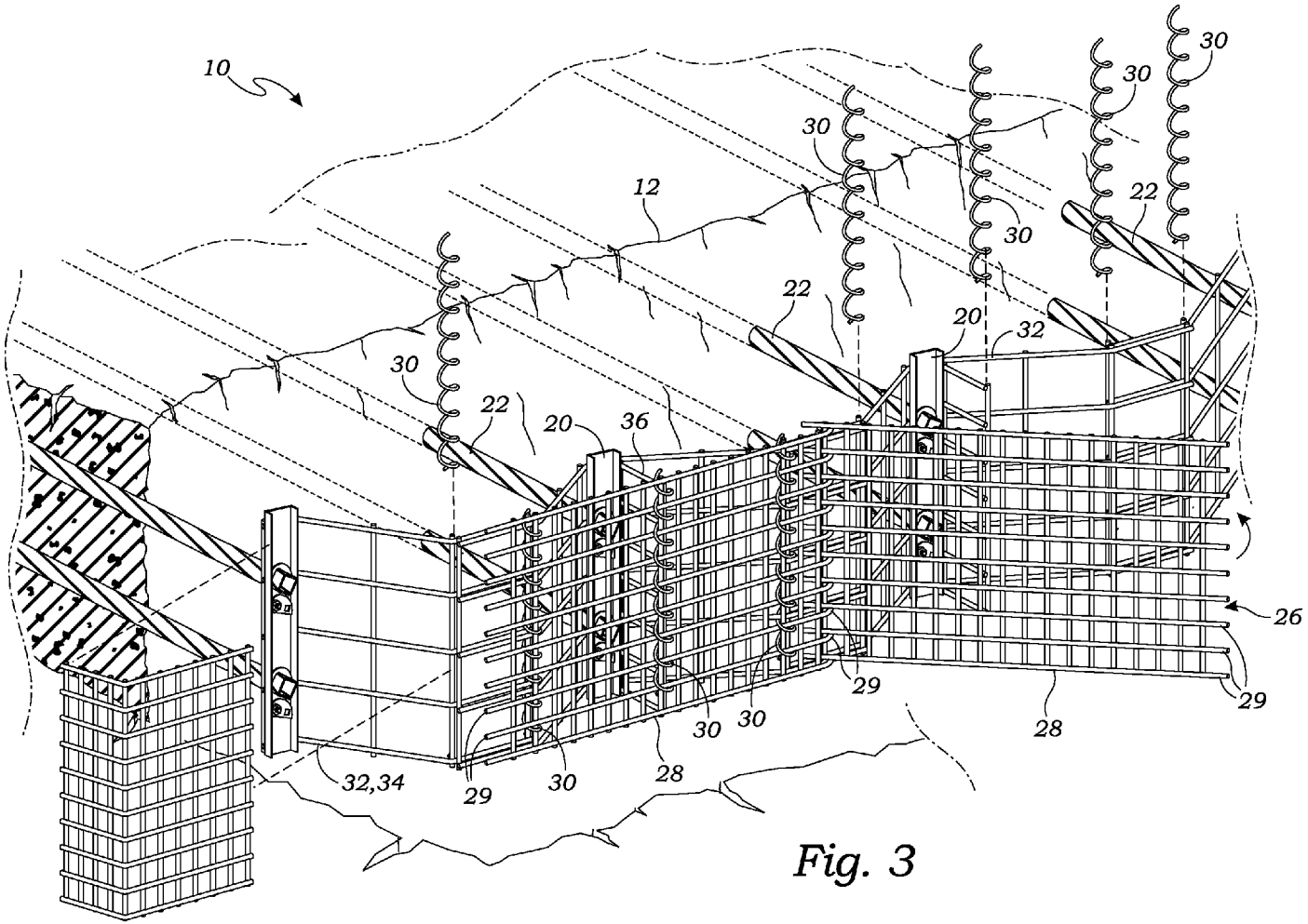
FIG. 3 is a perspective view of the retaining wall system, illustrating face panels being installed to cover the V-shaped portions of the truss elements.

FIG. 1 is an exploded perspective view of a first step in the construction of one embodiment of the retaining wall system 10. FIG. 2 is a perspective view of the retaining wall system 10 following installation of additional elements. FIG. 3 is a perspective view of the retaining wall system 10. As shown in FIGS. 1-3, the retaining wall system 10 includes a plurality of pilasters 20, a plurality of spiralnails 22, a locking mechanism 24, a wire truss system 26, and a plurality of face panels 28.

As illustrated in FIGS. 1-3, the plurality of pilasters 20 may be in the form of elongate posts, as described in greater detail below. The plurality of pilasters 20 may be vertically mounted and horizontally spaced on the earthen embankment 12. At least one spiralnail 22 may be attached to each of the pilasters 20 to anchor the pilasters 20 into the earthen embankment 12 and provide support to the wire truss system 26. The spiralnails 22 may be locked in place by the locking mechanism 24, which is discussed in greater detail below, or via alternative attachment devices or mechanisms, and suitable alternative attachments should be considered within the scope of the present invention. For purposes of this application, the term "earthen embankment" is defined to include any form of embankment, slope, or formation that may require a retaining wall.

The spiralnails 22 may be any form of elongate structure suitable for being driven into the earthen embankment 12 as discussed herein. In the present embodiment, the spiralnails 22 are elongate generally rectilinear steel tubes that are shaped into a polyhedral cross section (or other suitable shape), and then twisted about a longitudinal axis to form a spiral thread. The spiral-shaped configuration of the spiralnail 22 is of such proportions and pitch that the nail will screw itself into place in response to being hammered into the earthen embankment 12. The structure of the spiralnail 22 is discussed in greater detail in Hilfiker et al., U.S. Pat. No. 6,874,975, which is hereby incorporated by reference in full.

As illustrated in FIGS. 1-3, the wire truss system 26 is shaped and structured for resisting the lateral pressure of soil in order to stabilize a slope and/or otherwise provide useful areas at different elevations. In the embodiment of FIGS. 1-3 the wire truss system 26 is operably mounted on the plurality of pilasters 20. The wire truss system 26 may include plurality of truss elements 32. While one chain of truss elements 32 is illustrated, multiple tiers of truss elements 32 will typically be used to stabilize a typical earthen embankment 12.

The plurality of truss elements 32 may include a wire lattice body 34, a pilaster attachment portion 38, and an interlocking portion 40, to be discussed in detail below. While FIGS. 1-3 illustrate one embodiment of the wire truss system 26, one skilled in the art may design alternative embodiments that remain within the scope of the present invention.

The wire lattice body 34 of the truss element, illustrated in FIGS. 1-3, prevents soil from moving past the retaining wall system 10. The wire lattice body 34 may be planar and formed of wire lattice. In the embodiment of FIGS. 1-3, the wire lattice body 34 may include a V-shaped portion 42, such that the wire lattice body 34 may extend outwardly from a center apex 44 at an angle of between 10-80 degrees from the plane of the plurality of face panels 28. The term "V-shaped portion" is defined to include not only a generally V-shaped structure, but also equivalent structures, such as a parabolic (or "U-shaped") structure, that is equivalent to the present invention. Therefore, while FIGS. 1-3 illustrate one embodiment of the wire lattice body 34 and the V-shaped portion 42, those skilled in the art may devise alternative embodiments, and these equivalent embodiments are considered within the scope of the present invention.

As shown in FIGS. 1-3, the plurality of face panels 28 are operably attached to the wire truss system 26 for covering the V-shaped portions 42 of the truss elements 32. The face panels 28 may be generally rectangular walls (although other shapes might be used, if desired) formed of wire lattice that are sized and shaped to cover the V-shaped portions 42, and may further extend to form a complete wall to contain the earthen embankment 12. Furthermore, prongs 29 may extend from each of the face panels 28, to enable adjacent face panels 28 to be physically connected to each other, to provide greater structural integrity to the retaining wall system 10.

In the embodiment of FIGS. 1-3, each of the plurality of face panels 28 is disposed on a plane and may be mounted on the truss elements 32, as discussed below. In an alternative embodiment, discussed below, the face panels 28 are integrally formed with the wire lattice body 34 of the adjacent truss element 32. Those skilled in the art may design alternative embodiments of the face panels 28, and such alternative embodiments should be considered within the scope of the present invention.

Fasteners 30, such as spiral binders, may be used to adjoin the truss elements 32 by wrapping around both of the truss elements 32, as illustrated in FIGS. 1-3. In this embodiment, the spiral binders 30 also wrap around portions of the face panels 28 as well, securing the entire construction together. The spiral binders 30 may be elongate rods formed into a spiral shape that is shaped and sized to fit around portions of both the truss elements 32 and/or the portions of the face panels 28. While the spiral binders 30 illustrate one embodiment of acceptable fasteners, alternative fasteners known in the art may also be used, including tire wires, zip ties, and/or any forms of hooks, welding, or other alternatives known to one skilled in the art.

As illustrated in FIGS. 1-3, a wire stiffening wall 36 may be further included to attach the face panel 28 to the truss element 32. As illustrated in FIGS. 1-3, the wire stiffening wall 36 is perpendicular to the plane of the face panels 28 and extends between a center apex 44 of the truss element 32 and one of the face panels 28. The wire stiffening wall 36 increases the structural integrity of the wire truss system 26, and particularly the V-shaped portions 42, when installed in the earthen embankment 12. Much like the wire lattice body 34, the wire stiffening wall 36 may be constructed out of wire lattice, although other suitable structures may be used to strengthen the wire truss system 26 as described herein.

The wire stiffening wall 36 may be operably attached to the wire lattice body 34 and the face panels 28 with the spiral binders 30, or with other suitable attachment devices or mechanisms. It should be noted that one skilled in the field may design alternative forms of wire stiffening walls 36 and means of attachment while still remaining within the scope of the present invention.

As illustrated in FIGS. 1-3, the pilaster attachment portion 38 operably attaches the wire lattice body 34 to the pilasters 20. In the embodiment of FIGS. 1-3, the pilaster attachment portion 38 is formed in the center apex 44 of the V-shaped portion 42, and provides a suitable surface to which the pilaster 20 may attach. By positioning the pilaster attachment portion 38 between the pilaster 20 and the earthen embankment 12, the pilaster attachment portion 38 serves to anchor the wire truss system 26 to the earthen embankment 12. However, the pilaster attachment portion 38 may be formed at an alternative location along the wire lattice body 34, as deemed suitable by one skilled in the art, and such alternative embodiments are within the scope of the present invention.

As illustrated in FIGS. 1-3, the interlocking portion 40 of the wire truss system 26 provides a means by which one of the truss elements 32 may be interconnected with an adjacent truss element 32. In the embodiment of FIGS. 1-3, the interlocking portion 40 is formed by a planar wire lattice flange disposed on a plane that is generally parallel to the place of the face panel. As such, adjoining truss elements 32 may be interconnected by overlapping adjacent planar wire lattice flanges 40 and connecting them to each other with spiral binders 30 that wrap around both of the truss elements 32. However, alternative embodiments of the interlocking portion 40 may be devised by one skilled in the art while still remaining within the scope of the present invention.

Figure 4:
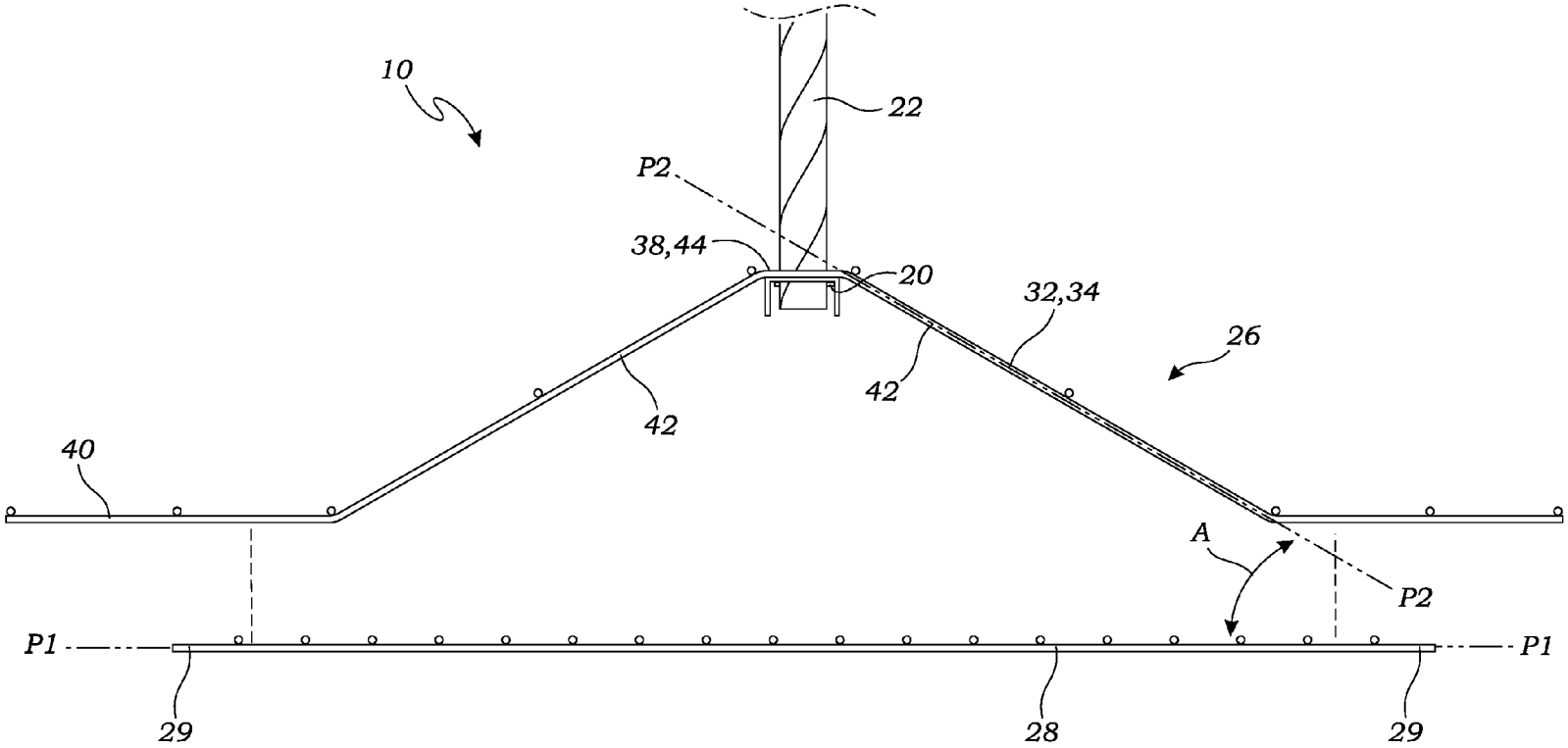
FIG. 4 is a top plan view of one of the truss elements and one of the face panels.

FIG. 4 is a top plan view of one of the truss elements 32 and one of the face panels. As illustrated in FIG. 4, the wire lattice body 34 is disposed on a first plane P1 and the face panel is disposed on a second plane P2. Angle A is formed by the intersection of the first and second planes P1 and P2. The pilaster 20 may operably attach to the pilaster attachment portion 38, to receive the spiralnail 22 therethrough. Additionally, the wire stiffening wall 36 may be adjoined to the center apex 44 of the wire lattice body 34, adjacent the pilaster 20. Although previously described as ranging between 10 and 80 degrees, the angle A may alternatively range from 15 to 50 degrees. Thus, alternative embodiments may be employed as deemed suitable by one skilled in the art.

Figure 5:
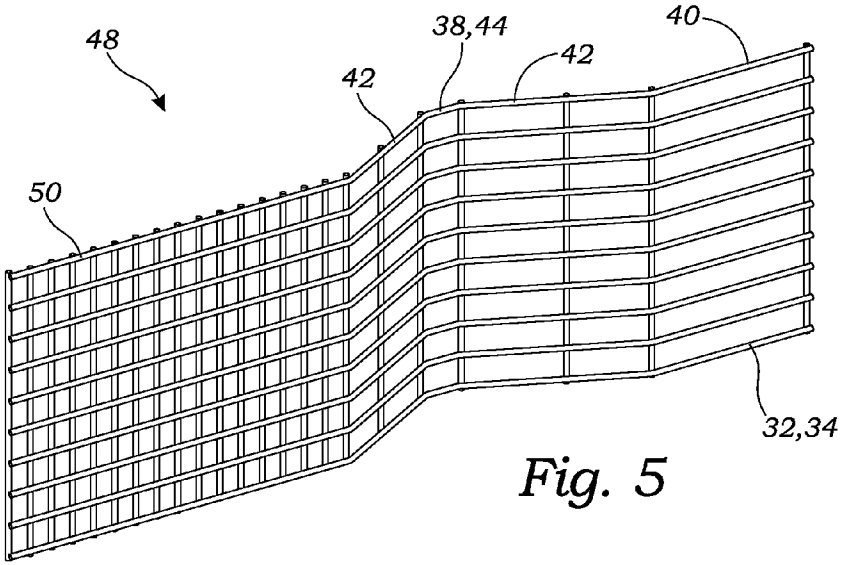
FIG. 5 is a perspective view of a second embodiment of one of the truss elements, illustrating an extended portion of the truss element.
Figure 6:
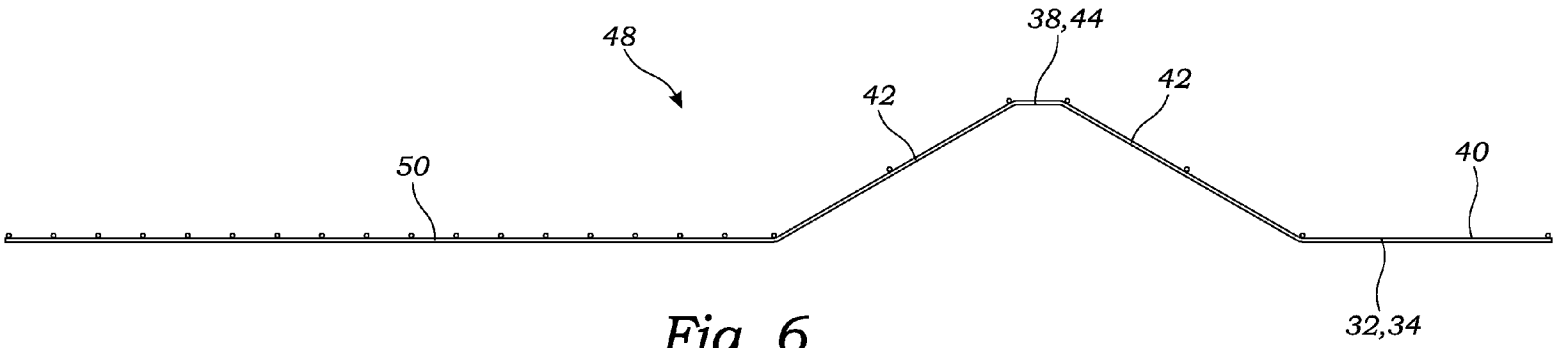
FIG. 6 is a top plan view thereof.

FIG. 5 is a perspective view of a second embodiment of one of the truss elements 48. FIG. 6 is a top plan view thereof. As shown in FIGS. 5 and 6, the second embodiment of one of the truss elements 48 includes an extended portion 50 of the truss element 48. The extended portion 50 of the truss element 48 may function as the face panel 28 to cover the V-shaped portion 42 of an adjacent truss element 48. In the embodiment of FIGS. 5 and 6, the extended portion 50 extends outwardly from the V-shaped portion 42 of the wire lattice body 34, such that the V-shaped portion 42 is not at the center of the truss element 48, as in previous embodiments discussed above. While FIGS. 5 and 6 illustrate one embodiment of the extended portion 50 of the truss element 48, those skilled in the art may devise alternative embodiments, and these alternative or equivalent structures are considered within the scope of the present invention.

Figure 7:
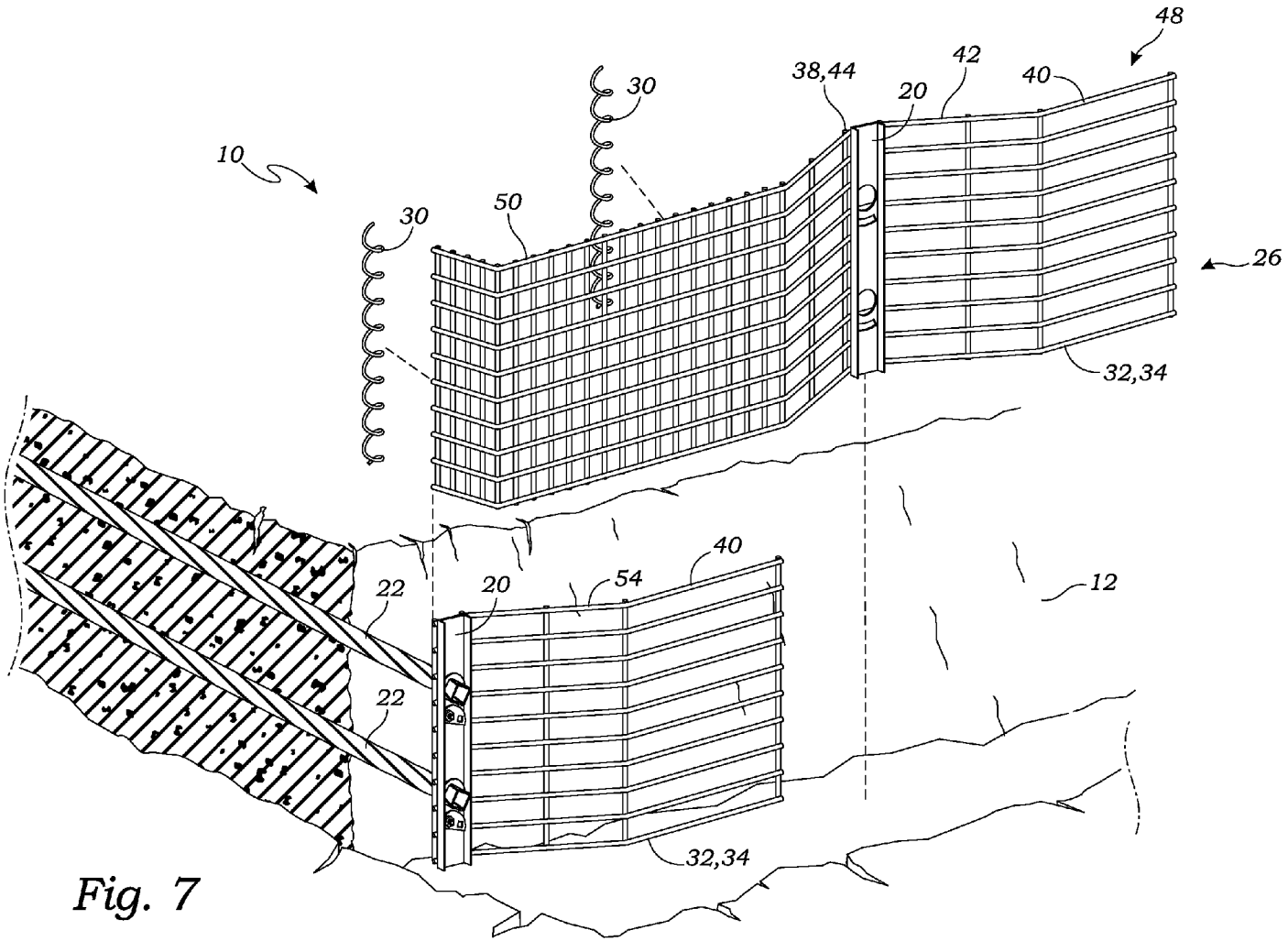
FIG. 7 is an exploded perspective view of a first step in the construction of a second embodiment of the retaining wall system, using the truss element of FIGS. 5-6.
Figure 8:
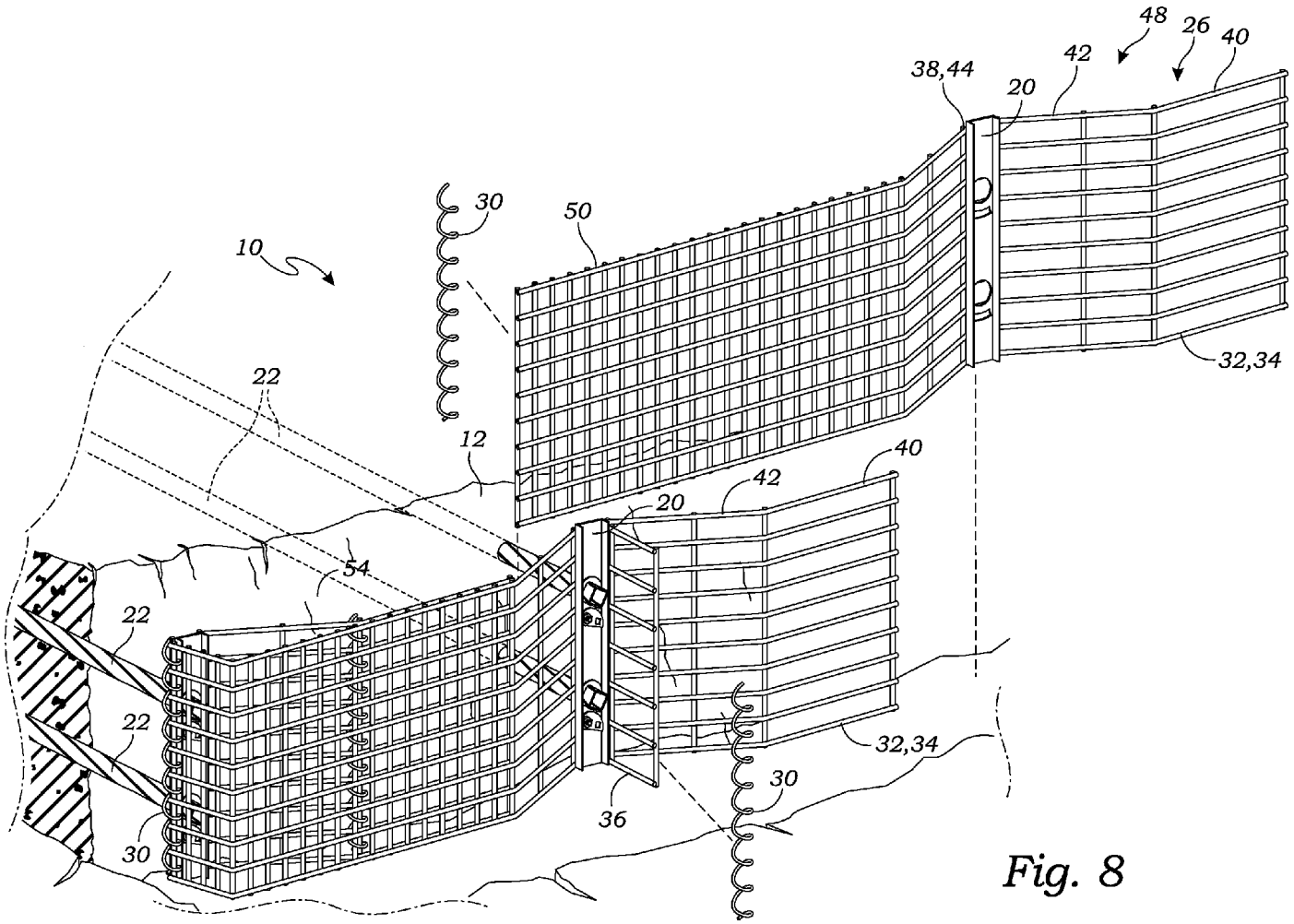
FIG. 8 is an exploded perspective view of the retaining wall system of FIG. 7, following installation of additional truss elements, illustrating the extended portion of each truss element being used to cover the V-shaped portion of the adjacent truss element.
Figure 9:
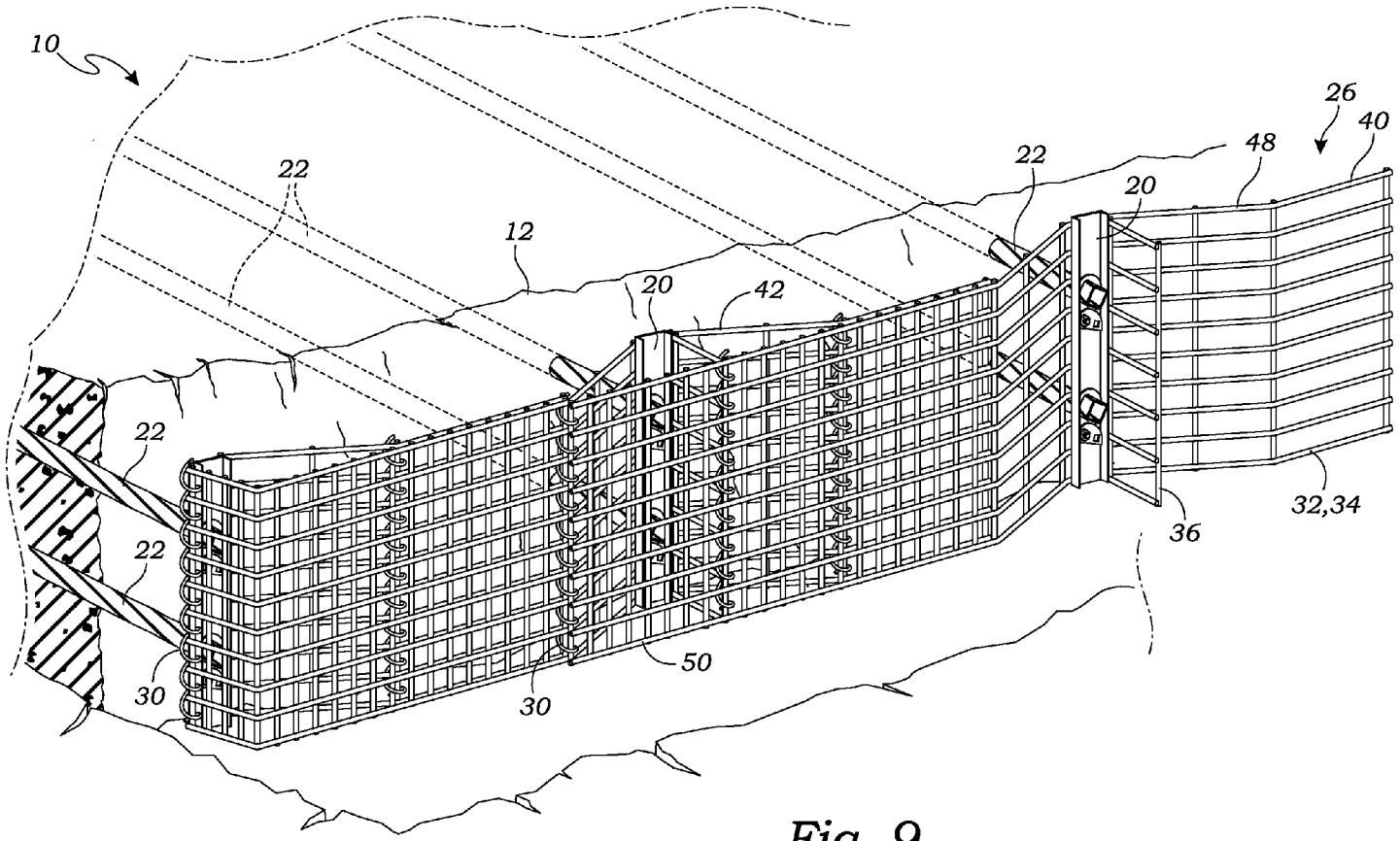
FIG. 9 is a perspective view of the retaining wall system of FIG. 8 once installed.
Figure 10:
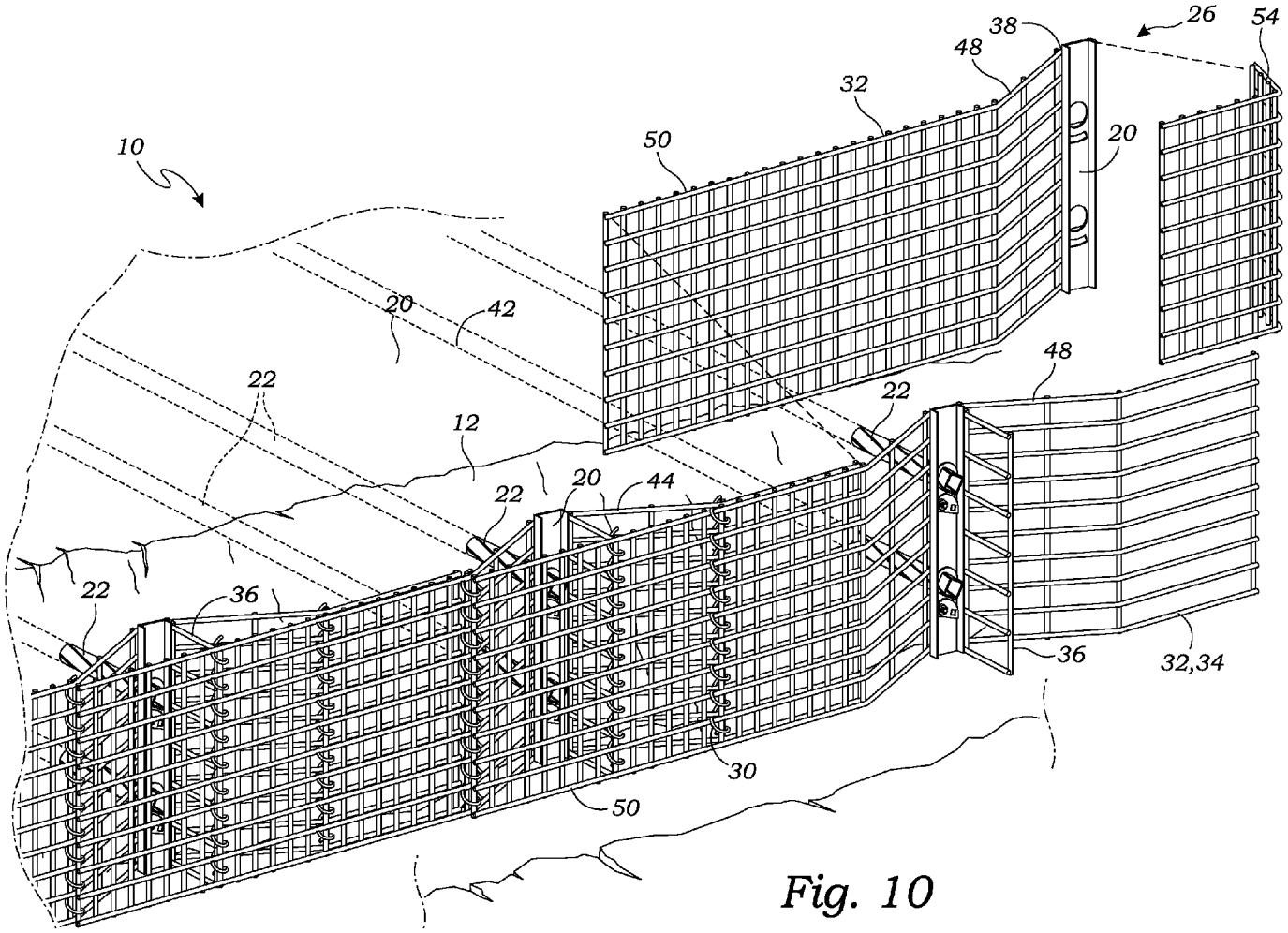
FIG. 10 is an exploded perspective view of the retaining wall system of FIG. 8, illustrating the installation of an end truss to complete the retaining wall system.
Figure 11:
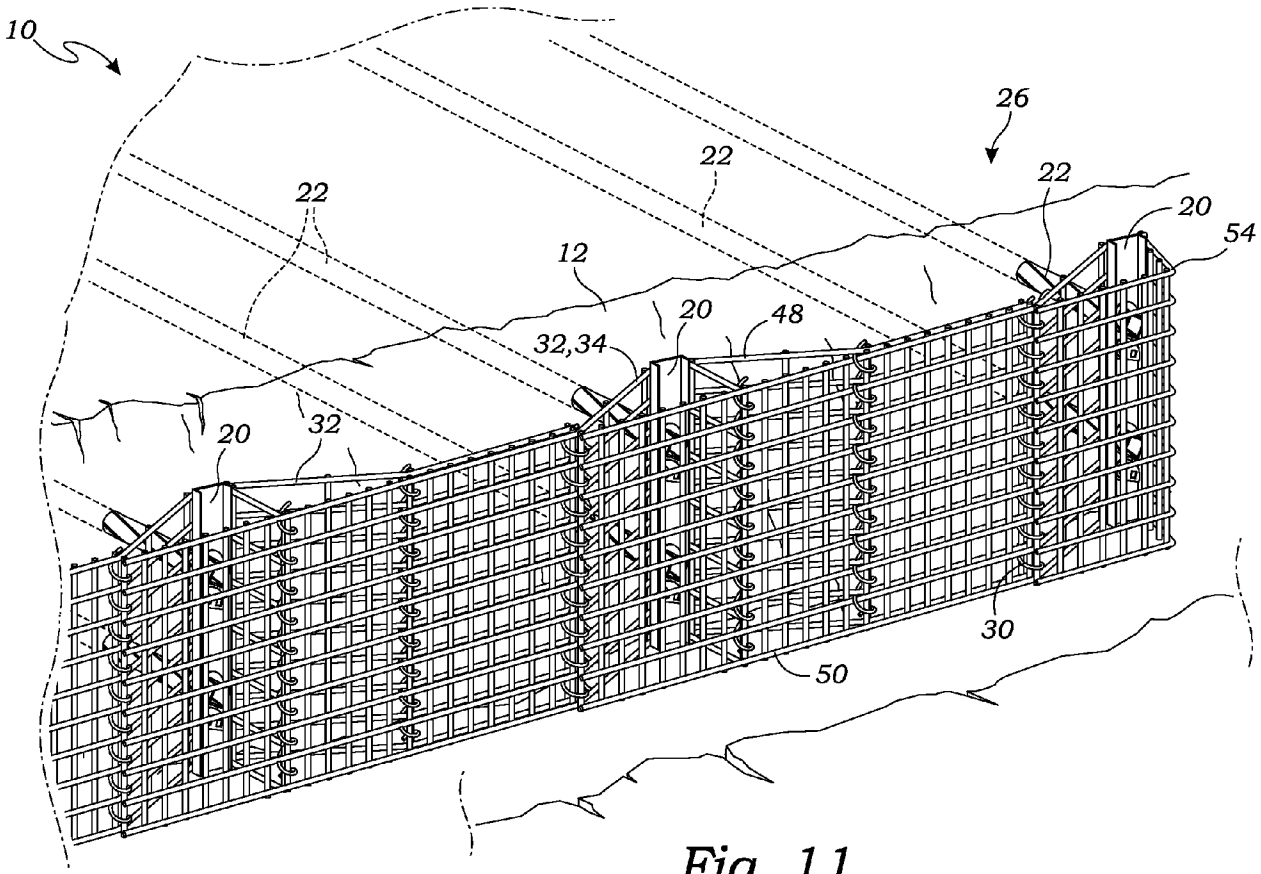
FIG. 11 is a perspective view thereof once installed.

FIG. 7 is an exploded perspective view of a first step in the construction of the second embodiment of the retaining wall system 10, using the truss element 48 of FIGS. 5-6. FIG. 8 is an exploded perspective view of the retaining wall system 10 of FIG. 7, following installation of additional truss elements 48, illustrating the extended portion 50 of each truss element 48 being used to cover the V-shaped portion 42 of the adjacent truss element 48. FIG. 9 is a perspective view of the retaining wall system 10 of FIG. 8. FIG. 10 is an exploded perspective view of the retaining wall system 10 of FIG. 8. FIG. 11 is a perspective view thereof.

As illustrated in FIGS. 7-11, the construction process of the second embodiment of the retaining wall system 10 includes several steps. FIG. 7 illustrates the plurality of pilasters 20 attached to the pilaster attachment portion 38 of the wire lattice body 34 and inserted into the earthen embankment 12. The truss elements 48 may be adjoined to one another via spiral binders 30, with the extended portions 50 of the truss elements 48 covering the V-shaped portion 42 of the wire lattice body 34, as shown in FIG. 8. The wire stiffening wall 36 of FIG. 9 may be operably mounted to the extended portion, to further attach the extended portion 50 to the truss element 48.

Additionally, in the embodiment of FIGS. 7-11, the present invention includes an end truss 54 used to complete the retaining wall system 10. The end truss 54 is a generally L-shaped structure formed out of wire lattice. It may be operably attached to the end of the truss element 48 once the desired length of the retaining wall system 10 has been reached. However, while one embodiment of the construction process and end truss 54 are illustrated in FIGS. 7-11, alternative embodiments devised by one skilled in the art are considered within the scope of the present discussion.

The present invention also includes a method of constructing a retaining wall system 10, as described above, for installation on an earthen embankment 12. In this method, the plurality of pilasters 20 are positioned in vertically mounted and horizontally spaced positions along the earthen embankment 12. Spiralnails 22 may then be driven into the earthen embankment 12, before being attached to one of the plurality of pilasters 20 as a means to anchor the pilasters 20 to the earthen embankment 12. The wire truss system 26 may be mounted on the plurality of pilasters 20 such that each of the pilasters 20 is attached to the pilaster attachment portion 38 of one of the truss elements.

Finally, the face panels 28 may be attached to the wire truss system 26, as discussed above, such that the face panels 28 cover the V-shaped portions 42 of the truss elements 32. Or, in the alternative, extended portions 50 of the second embodiment of the truss elements 48 may be positioned to cover the V-shaped portion 42, also as described above.

Figure 13:
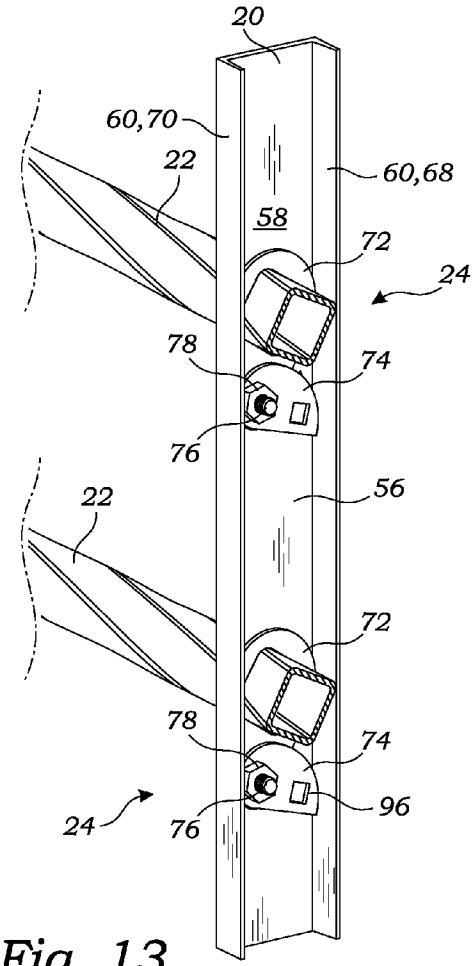
FIG. 13 is a perspective view thereof.
Figure 12:
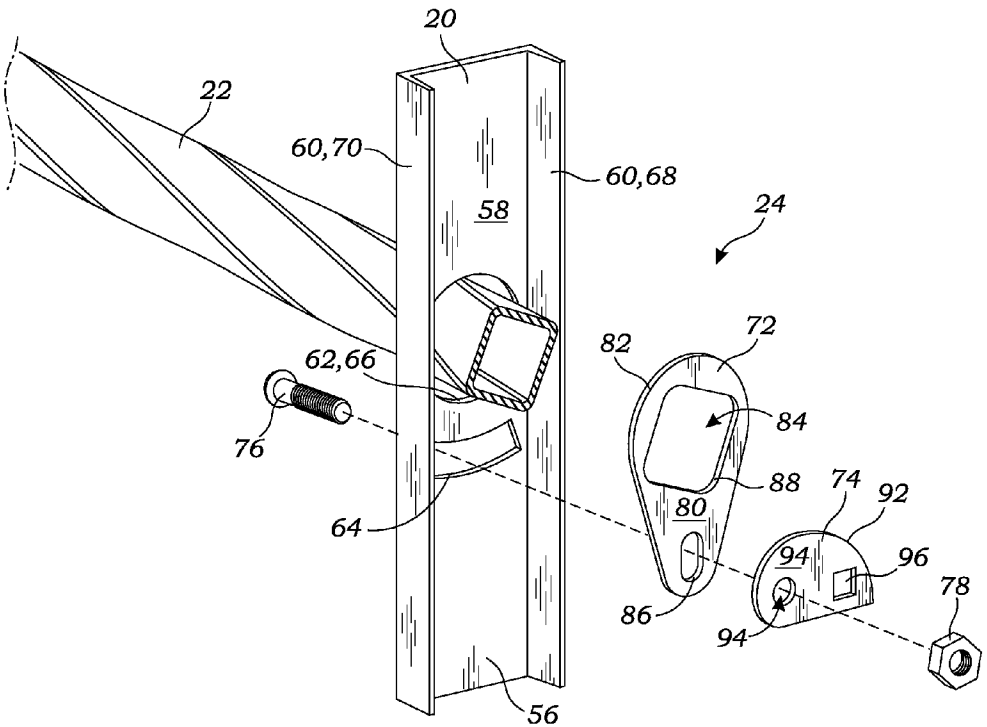
FIG. 12 is an exploded perspective view of a locking mechanism used to lock the pilaster to a spiralnail.
Figures 14, 15, 16:
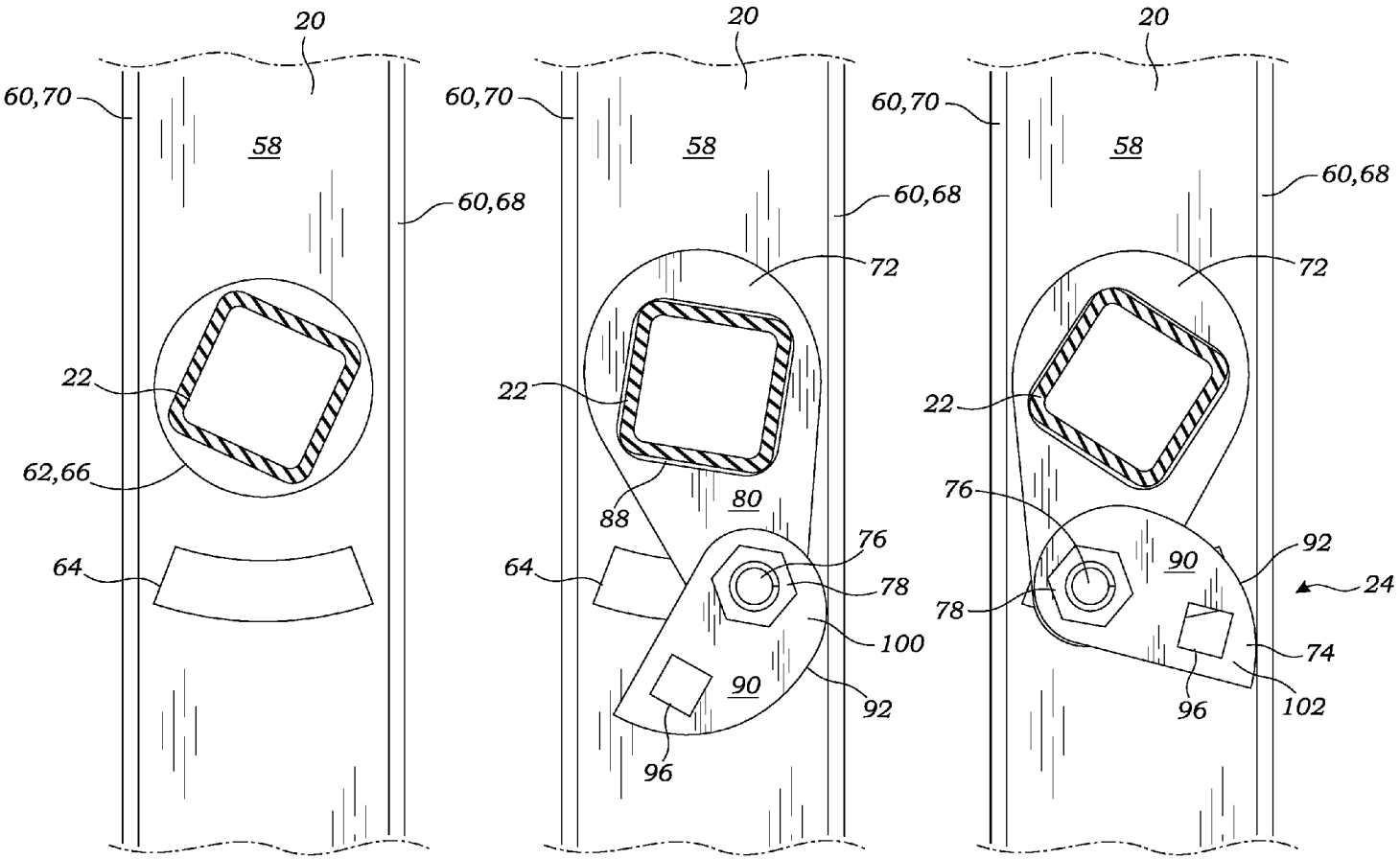
FIG. 14 is a front elevational view of the pilaster and the spiralnail.
FIG. 15 is a front elevational view of the locking mechanism in an untorqued position.
FIG. 16 is a front elevational view of the locking mechanism in a torqued position.

FIG. 12 is an exploded perspective view of the locking mechanism 24 according to one embodiment of the present invention, illustrating the spiralnail 22, the pilaster 20, and the locking mechanism 24. FIG. 13 is a perspective view of the locking mechanism 24 applied to two spiralnails 22 threaded through the pilaster. FIG. 14 is a front elevational view of the spiralnail 22 and the pilaster 20.

As illustrated in FIGS. 12-14, the pilaster 20 is shaped to receive the spiralnail 22 and provide support for the retaining wall system 10. In the embodiment of FIGS. 12-14, the pilaster 20 is a vertically extending column that is generally rectangular in shape. The pilaster 20 includes an elongate pilaster body 56, a front surface 58, and edge walls 60. The elongate pilaster body 56 may include a nail hole 62 which is shaped to receive the spiralnail 22 therethrough, as well as a bolt slot 64 adjacent the nail hole 62. In the present embodiment of FIGS. 12-14, the nail hole 62 has a curved perimeter 66 and the bolt slot 64 is also curved in order to match the curved perimeter 66 of the nail hole 62.

In this embodiment, the edge walls 60 of the elongate pilaster body 56 extend outwardly from the front surface 58 to form a right side 68 and a left side 70 of the pilaster 20. The pilaster 20 of FIGS. 12-14 may be constructed out of a sturdy material, such as steel, so as to prevent buckling, bending, or other structural damage to the retaining wall system 10. While FIGS. 12-14 illustrate an embodiment of the pilaster 20, those skilled in the art may devise alternative embodiments, and these alternative or equivalent designs are considered within the scope of this present invention.

As shown in FIGS. 12-14, the locking mechanism 24 includes a locking ring 72, a cam plate 74, a bolt 76, and a nut 78. The locking ring 72 of FIGS. 12 and 13 fits onto and interlocks with the spiralnail 22. The locking ring 72 may include opposed surfaces 80 that extend to a perimeter 82, and provide a nail engaging aperture 84 and a first bolt hole 86. The opposed surfaces 80 of the locking ring 72 terminate at the perimeter 82, or edge, and may form a disc-like shape. As illustrated in FIGS. 12 and 13, the nail engaging aperture 84 is located adjacent the first bolt hole 86 and has a perimeter 82 shaped to receive the spiralnail 22 therethrough in order to lockingly engage the spiralnail 22. The first bolt hole 86 may be an elongate shape (e.g., an oval or an ellipse) as a means to facilitate the installation of the locking mechanism 24, as described below. The locking ring 72 may be formed out of any strong and durable material, such as steel, that is suitable to lock the spiralnail 22 in place. Although FIGS. 12 and 13 illustrate one embodiment of the locking ring 72, alternative embodiments may be designed by one skilled in the art and are therefore considered within the scope of the present discussion.

As illustrated in FIGS. 12 and 13, the cam plate 74 of the locking mechanism 24 is used to rotate the locking ring 72, to lock and maintain a torque against the spiralnail 22. In the embodiment of FIGS. 12 and 13, the cam plate 74 includes opposed surfaces 80 that extend to a cam-shaped outer perimeter 92, a second bolt hole 94, and a torque application element 96. The second bolt hole 94 of the cam plate 74 is formed through the opposed surfaces 80 that extend to the cam-shaped outer perimeter 92. The torque application element 96 of FIGS. 12 and 13 may be a drive aperture through which a driver (not shown) may be inserted to increase torque and rotate the cam plate 74. In doing so, the cam-shaped outer perimeter 92 may contact one of the edge walls 60 of the pilaster 20 and acts as a lever to rotate the locking ring 72 and apply torque to the spiralnail 22. However, while FIGS. 12 and 13 illustrate one embodiment of the cam plate 74, alternative embodiments deemed suitable by those skilled in the art are considered to be within the scope of the present invention.

The bolt 76 and the nut 78, illustrated in FIGS. 12 and 13, are used to mount the locking ring 72 and the cam plate 74 on the pilaster 20. The bolt 76 is positioned through the bolt slot 64 of the pilaster 20, through the first bolt hole 86 of the locking ring 72, and then through the second bolt hole 94 of the cam plate 74. The nut 78 operably engages with the bolt 76 to tighten the cam plate 74 and the locking ring 72 against the pilaster 20. In the embodiment of FIGS. 12 and 13, the bolt 76 and nut 78 are of standard construction well known in the art; however, those skilled in the art may devise alternative embodiments which are still considered within the scope of the present invention.

FIG. 15 is a front elevational view of the locking mechanism 24 in an untorqued position. As shown in FIG. 15, when the locking mechanism 24 is assembled and the nut 78 is initially tightened, the bolt 76 and the nut 78 initially rotate counter-clockwise (in this embodiment) until a smaller-diameter portion 100 of the cam-shaped outer perimeter 92 abuts the edge wall of the pilaster 20.

FIG. 16 is a front elevational view of the locking mechanism 24 in a torqued position. As illustrated in FIG. 16, once a driver (not shown) has been attached to the torque application element 96, it may be used to turn the cam plate 74 to the torqued position, wherein a larger-diameter portion 102 of the cam-shaped outer perimeter 92 abuts the edge wall of the pilaster 20. This rotation turns the locking ring 72 and imparts a torque to the spiralnail 22. As a result, the spiralnail 22 is locked into position within the nail hole 62 of the pilaster 20, thus providing support and stability to the retaining wall system 10. Although FIG. 16 illustrates one embodiment of the torqued position of the locking mechanism 24, those skilled in the art may devise alternative embodiments while still remaining within the scope of the present invention.

The invention also includes a method of using the locking mechanism 24, described above, for locking the spiralnail 22 in the retaining wall system 10. In this method, the spiralnail 22 may be inserted through the nail hole 62 in the pilaster 20, before being inserted through the nail engaging aperture 84 of the locking ring 72. The bolt 76 may then be inserted behind the pilaster 20 into the curved bolt slot 64 and through the first bolt hole 86 in the locking ring 72. The bolt 76 may then be threaded through the second bolt hole 94 of the cam plate 74. These elements may then be tightened by the nut 78 and pressed against the front surface 58 of the pilaster 20. One may finger tighten the nut 78 and rotate the cam plate 74 counter-clockwise to lock against the right side 68 of the pilaster 20. Torque may then be applied to the drive aperture in the cam plate 74 in order to rotate to the right side 68 of the pilaster 20. In doing so, the cam-shaped outer perimeter 92 may contact one of the edge walls 60 of the pilaster 20 and acts as a lever to rotate the locking ring 72 and apply torque to the spiralnail 22. Once in the torqued position, the spiralnail 22 is locked into place within the pilaster 20, to provide support to the entire retaining wall system 10.

While FIGS. 12-16 illustrate one embodiment of how the spiralnails 22 may be attached to the pilasters 20, alternative or equivalent devices or mechanisms may also be used (e.g., bolts, welding, etc.). Any alternative or equivalent devices or mechanisms that may be devised by one skilled in the art should be considered within the scope of the present invention.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A retaining wall system for installation on an earthen embankment, the retaining wall system comprising:

a plurality of pilasters that are horizontally spaced along the earthen embankment, each of the plurality of pilasters having an elongate pilaster body that is vertically mounted on the earthen embankment;

a plurality of spiralnails that have each been driven into the earthen embankment and attached to one of the plurality of pilasters for anchoring the pilasters in the earthen embankment;

a wire truss system operably mounted on the plurality of pilasters, the wire truss system including a plurality of truss elements that each include a pilaster attachment portion, a wire lattice body, and an interlocking portion that interlocks with at least one adjacent truss element, wherein the wire lattice body includes a V-shaped portion; and a plurality of face panels that are operably attached to the wire truss system for covering the V-shaped portions of the truss elements.

2. The retaining wall system of claim 1, wherein each of the plurality of face panels is disposed on a plane;

wherein the pilaster attachment portion is formed in a center apex of the V-shaped portion;

wherein the wire lattice body extends outwardly from the center apex at an angle of between 10-80 degrees from the plane of the face panel; and wherein the interlocking portions are provided by planar wire lattice flanges that are disposed on a plane that is generally parallel to the plane of the face panel.

3. The retaining wall system of claim 2, wherein adjoining truss elements are interconnected by overlapping the adjacent planar wire lattice flanges and connecting them to each other with spiral binders that wrap around both of the truss elements.

4. The retaining wall system of claim 2, wherein the face panels are generally rectangular walls formed of wire lattice.

5. The retaining wall system of claim 2, further comprising wire stiffening walls that are perpendicular to the plane of the face panel system and extend between the center apex of the truss element and one of the face panels, for further attaching the face panel to the truss element.

6. The retaining wall system of claim 1, wherein each of the plurality of pilasters includes an elongate pilaster body that includes a plurality of nail holes shaped to receive the spiralnail therethrough.

7. The retaining wall system of claim 6, wherein the elongate pilaster body of each of the plurality of pilasters has a front surface and edge walls extending outwardly from the front surface.

8. The retaining wall system of claim 1, wherein each of the spiralnails is attached to one of the pilasters with a locking mechanism that applies a torque to each of the spiralnails.

9. The retaining wall system of claim 1, wherein the wire lattice body of the V-shaped portion extends outwardly from the center apex at an angle of between 15-50 degrees from the plane of the plurality of face panels.

10. The retaining wall system of claim 1, wherein the face panel is integrally formed with the wire lattice body of an adjacent truss element.

11. A retaining wall system for installation on an earthen embankment, the retaining wall system comprising:

a plurality of pilasters that are horizontally spaced along the earthen embankment, each of the plurality of pilasters having an elongate pilaster body that is vertically mounted on the earthen embankment;

a plurality of spiralnails that have each been driven into the earthen embankment and attached to one of the plurality of pilasters for anchoring the pilasters in the earthen embankment;

a wire truss system operably mounted on the plurality of pilasters, the wire truss system including a plurality of truss elements that each include a pilaster attachment portion, a wire lattice body, and an interlocking portion that is adapted to be interlocked with at least one adjacent truss element;

wherein the wire lattice body includes a V-shaped portion in which the pilaster attachment portion is formed in a center apex of the V-shaped portion; and further comprising a plurality of face panels that are operably attached to the wire truss system for covering the V-shaped portions of the truss elements.

12. The retaining wall system of claim 11, wherein the wire lattice body extends outwardly from the center apex at an angle of between 10-80 degrees from the plane of the face panel; and wherein the interlocking portions are provided by planar wire lattice flanges that are disposed on a plane that is generally parallel to the plane of the face panel.

13. The retaining wall system of claim 11, wherein adjoining truss elements are interconnected by overlapping the adjacent planar wire lattice flanges and connecting them to each other with spiral binders that wrap around both of the truss elements.

14. The retaining wall system of claim 11, wherein the face panels each include prongs extending therefrom, the prongs being shaped and sized so that they may be interconnected with the prongs from an adjacent face panel to physically interconnect the face panels.

15. A method for constructing a retaining wall system, the method comprising the steps of:

providing the retaining wall system comprising:

a plurality of pilasters;

a plurality of spiralnails;

a wire truss system including a plurality of truss elements that each include a pilaster attachment portion, a wire lattice body, and an interlocking portion, wherein the pilaster attachment portion is formed at a center apex of a V-shaped portion of the wire lattice body; and a face panel system comprising a plurality of face panels;

positioning the plurality of pilasters in vertically mounted and horizontally spaced positions along an earthen embankment;

driving the plurality of spiralnails into the earthen embankment attaching each of the spiralnails to one of the plurality of pilasters for anchoring the pilasters to the earthen embankment;

mounting the wire truss system on the plurality of pilasters such that each of the pilasters is attached to the pilaster attachment portion of one of the truss elements;

connecting the interlocking portions of adjacent truss elements;

attaching the face panel system to the wire truss system such that the face panels cover the V-shaped portions of the truss elements.

* * * * *